US006897757B2

(12) United States Patent
Kim

(10) Patent No.: US 6,897,757 B2
(45) Date of Patent: May 24, 2005

(54) ACCESSORY DEVICE FOR MANUAL MOTOR STARTER

(75) Inventor: Ho Soung Kim, Cheongju-si (KR)

(73) Assignee: Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 10/728,821

(22) Filed: Dec. 8, 2003

(65) Prior Publication Data

US 2004/0114293 A1 Jun. 17, 2004

(30) Foreign Application Priority Data

Dec. 14, 2002 (KR) ..... 10-2002-0079969

(51) Int. Cl.[7] ..... H01F 21/06
(52) U.S. Cl. ..... 336/130; 335/14; 335/132
(58) Field of Search ..... 336/130–132; 335/14, 20, 132, 202; 361/42–50; 200/293–308

(56) References Cited

U.S. PATENT DOCUMENTS 4,641,117 A * 2/1987 Willard ..... 335/7
4,700,161 A * 10/1987 Todaro et al. ..... 335/172
4,864,262 A * 9/1989 Deb ..... 335/20

* cited by examiner

*Primary Examiner*—Tuyen T. Nguyen
(74) *Attorney, Agent, or Firm*—Greenblum & Bernstein, P.L.C.

(57) ABSTRACT

Disclosed is an accessory device for a manual motor starter attached to one side of a body of the manual motor starter so as to perform various accessory functions, such as a forcible trip function for the manual motor starter by remotely switching the manual motor starter or a trip function for the manual motor starter when under-voltage occurs between a power source and load. A remotely switchable trip function and under-voltage trip function are achieved by using one accessory device.

3 Claims, 5 Drawing Sheets

ACCESSORY DEVICE FOR MANUAL MOTOR STARTER

BACKGROUND OF THE INVENTION

1. Field of the Invention

The present invention relates to an accessory device for a circuit breaker for protecting a motor called "manual motor starter", particularly to an accessory device for a manual motor starter attached to one side of a body of the manual motor starter so as to perform various accessory functions, such as a forcible trip function for the manual motor starter by remotely switching the manual motor starter or a trip function for the manual motor starter when under-voltage occurs between a power source and load, and more particularly to an accessory device for a manual motor starter capable of performing both remotely switchable trip function and under-voltage trip function.

2. Description of the Prior Art

As generally known in the art, various accessory devices are selectively attached to a manual motor starter in match with various purposes of the manual motor starter.

For instance, if a remotely switchable trip device called "shunt trip device (SET)" is attached to one side of a body of the manual motor starter, a user can simply trip the manual motor starter from a remote place in an emergency by supplying power through a switch without manually operating a handle of the manual motor starter. In addition, when an under-voltage trip device (UVT) is attached to one side of the body of the manual motor starter, the under-voltage trip device detects under-voltage on a circuit if voltage lower than rated voltage is applied to the circuit, thereby automatically tripping the manual motor starter for protecting the circuit.

FIG. 1 is a perspective view showing a manual motor starter having an accessory device 2. The accessory device 2 is coupled to one side of a body 1 of the manual motor starter.

The accessory device 2 is provided with a lever 3 (referred to FIG. 2), and a leading end of the lever 3 extends into an interior of the body 1 in such a manner that a switching mechanism installed in the body 1 is interlocked with the leading end of the lever 3 in order to trip the manual motor starter.

FIGS. 2 and 3 are longitudinal sectional views showing a conventional under-voltage trip accessory device and a remotely switchable trip accessory device, respectively.

Although it is not illustrated in FIG. 2, a magnet including a fixed core and a movable core is installed in the under-voltage trip accessory device 2. The lever 3 is coupled to the movable core so as to move together with the lever 3.

In a normal state of the under-voltage trip accessory device 2, if magnetic flux is generated from a coil due to current applied to the coil, the fixed core is magnetized due to magnetic flux so that the fixed core generates attracting force. The moving core moves towards the fixed core due to attracting force of the fixed core so that the movable core is in contacts with the fixed core. In addition, when under-voltage is applied to the coil, attracting force generated from the fixed core becomes weak, so the movable core is released from the fixed core due to elastic force of a spring (number is not designated) installed at a lower portion of the movable core. At this time, the lever 3 connected to the movable core is moved in a downward direction together with the movable core. Accordingly, as the lever 3 downwardly moves, the switching mechanism engaged with the leading end of the lever 3 in the body 1 of the manual motor starter is operated so that the manual motor starter is tripped.

In a case of the remotely switchable trip accessory device 2 shown in FIG. 3, the movable core is installed at an upper portion of the coil and the lever 3 is engaged with the movable core. When it is required to forcibly trip the manual motor starter by remotely switching the manual motor starter, a switch installed at a remote place is closed so that current is applied to the coil from an AC power source. Thus, magnetic flux is generated from the coil, so the fixed core is magnetized due to magnetic flux of the coil. Accordingly, the movable core downwardly rotates about a rotating point thereof towards the fixed core due to attracting force generated from the magnetized fixed core. Then, the lever 3 connected to the movable core is downwardly moved so that a part of the lever 3 extends into an interior of the body of the manual motor starter. The part of the lever 3 extending into the interior of the body of the manual motor starter operates the switching mechanism installed in the body of the manual motor starter, thereby forcibly tripping the manual motor starter. Meanwhile, if the switch is opened, current applied to the coil is shut off, so the coil does not generate magnetic flux. Thus, the fixed core is demagnetized so that the fixed core does not generate attracting force. Accordingly, the movable core is rotatably moved in an upward direction apart from the fixed core due to elastic force of a spring installed at a lower portion of the movable core.

However, according to the conventional manual motor starter, only one of the remotely switchable trip accessory device and the under-voltage trip accessory device is selectively coupled to one side of the body 1 of the manual motor starter. Accordingly, when a circuit performing both remotely switchable trip function and under-voltage trip function is required, an additional manual motor starter must be coupled to the manual motor starter in series.

This is because the accessory device 2 can be attached only to one side of the manual motor starter due to a structural limitation of the manual motor starter. That is, a lever hole for receiving the lever 3 and a connection member cooperated with the lever 3 of the accessory device 2 in the body 1 of the manual motor starter are provided only at one side of the body 1 of the manual motor starter. Accordingly, in order to make the circuit capable of performing the above-described two trip functions, two manual motor starters are necessary. Therefore, the conventional manual motor starter and the accessory device thereof increase manufacturing cost and require an installation space larger than a whole area of two manual motor starters and two accessory devices. In addition, a circuit structure connecting the power source to the manual motor starter and load is complicated.

SUMMARY OF THE INVENTION

Accordingly, the present invention has been made to solve the above-mentioned problems occurring in the prior art, and an object of the present invention is to provide an accessory device for a manual motor starter attached to one side of a body of the manual motor starter and capable of performing both remotely switchable trip function and under-voltage trip function.

To accomplish the above object, the present invention provides an accessory device for a manual motor starter, the accessory device comprising: a case forming an outer appearance of the accessory device; an under-voltage trip coil section installed in the case and including an under-voltage trip coil for generating magnetic flux depending on voltage applied thereto and a first fixed core installed adjacent to the under-voltage trip coil and magnetize by magnetic flux generated from the under-voltage trip coil, thereby generating attracting force; a remotely switchable trip coil section installed in the case and including a remotely switchable trip coil for generating magnetic flux depending on remotely switchable electric source voltage applied thereto, a second fixed core generating attracting force when the second fixed core is magnetized by magnetic flux generated from the remotely switchable trip coil, and a first movable core having a rod portion extending downward and movable in a downward direction when attracting force is applied thereto from the second fixed core; an under-voltage trip power source terminal electrically connected to the under-voltage trip coil so as to apply voltage to the under-voltage trip coil; a remotely switchable trip power source terminal electrically connected to the remotely switchable trip coil so as to apply remotely switchable electric source voltage to the remotely switchable trip coil; a second movable core separated from the first fixed core in a downward direction when under-voltage is applied thereto through the under-voltage trip power source terminal and downwardly rotated pressed by the rod portion of the first movable core when voltage is applied to the remotely switchable trip coil through the remotely switchable trip power source terminal; and a lever mechanically connected to the second movable core so as to move together with the second movable core for tripping the manual motor starter.

BRIEF DESCRIPTION OF THE DRAWINGS

The above and other objects, features and advantages of the present invention will be more apparent from the following detailed description taken in conjunction with the accompanying drawings, in which:

FIGS. 6 and 7 are longitudinal sectional views of an accessory device according to one embodiment of the present invention, in which FIG. 6 shows a movable core attached to a fixed core due to attracting force of the fixed core and FIG. 7 shows the movable core separated from the fixed core due to a remote switching operation.

DETAILED DESCRIPTION OF THE PREFERRED EMBODIMENTS

Figure 1:
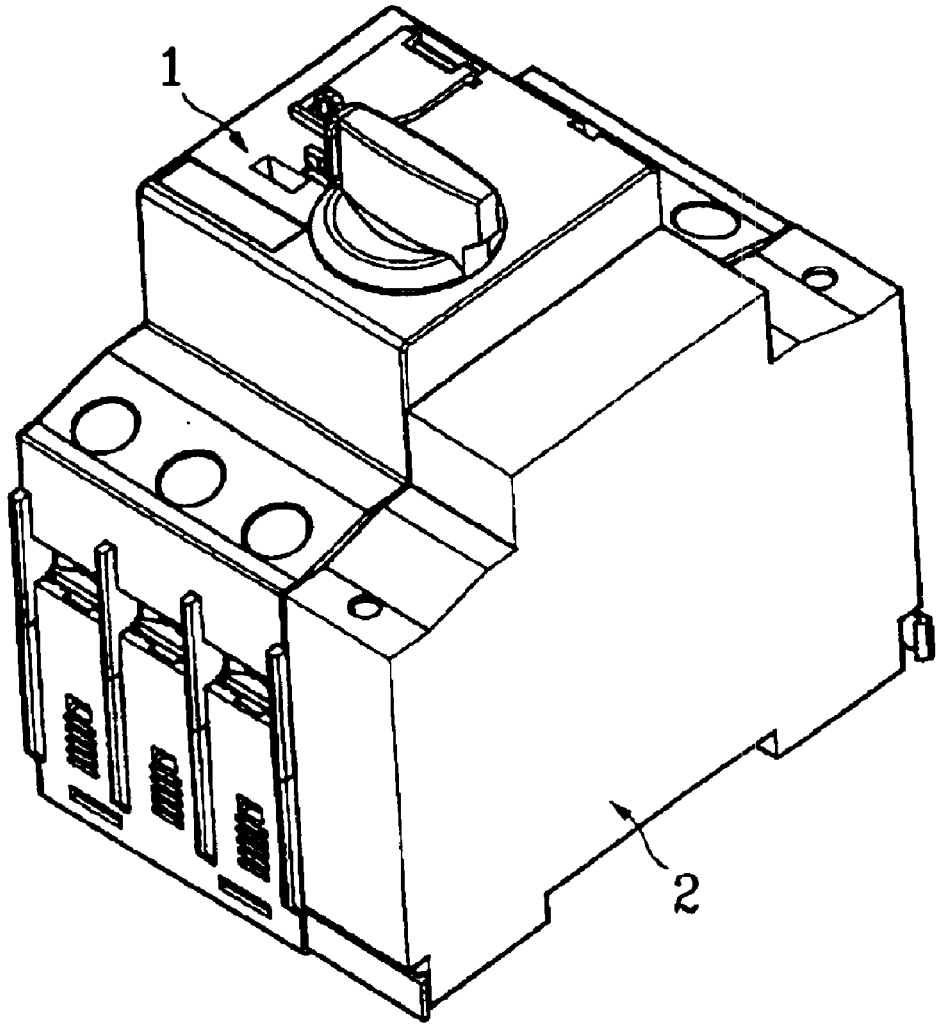
FIG. 1 PRIOR ART
FIG. 1 is a perspective view showing a manual motor starter having an accessory device attached to one side thereof.
Figure 2:
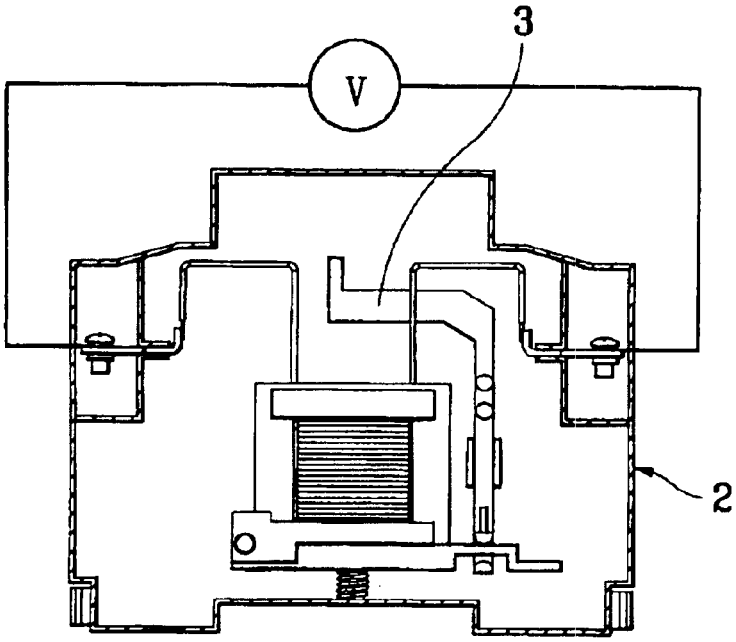
FIG. 2 PRIOR ART
FIG. 2 is a longitudinal sectional view of a conventional under-voltage trip accessory device.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 4:
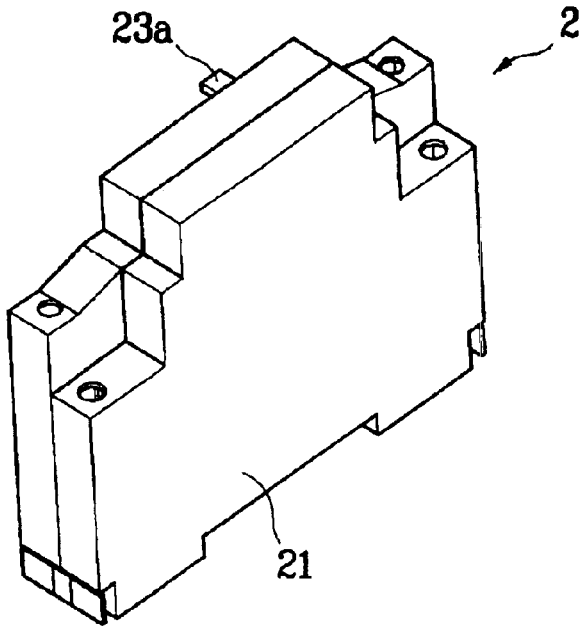
FIG. 4 is a perspective view showing an accessory device according to one embodiment of the present invention.
Figure 5:
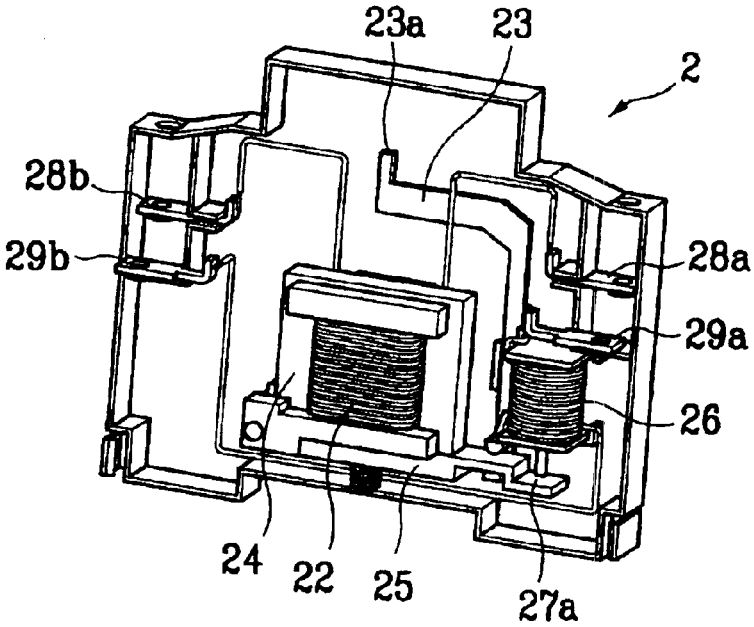
FIG. 5 is a perspective view showing an interior of an accessory device according to one embodiment of the present invention.
Figure 6:
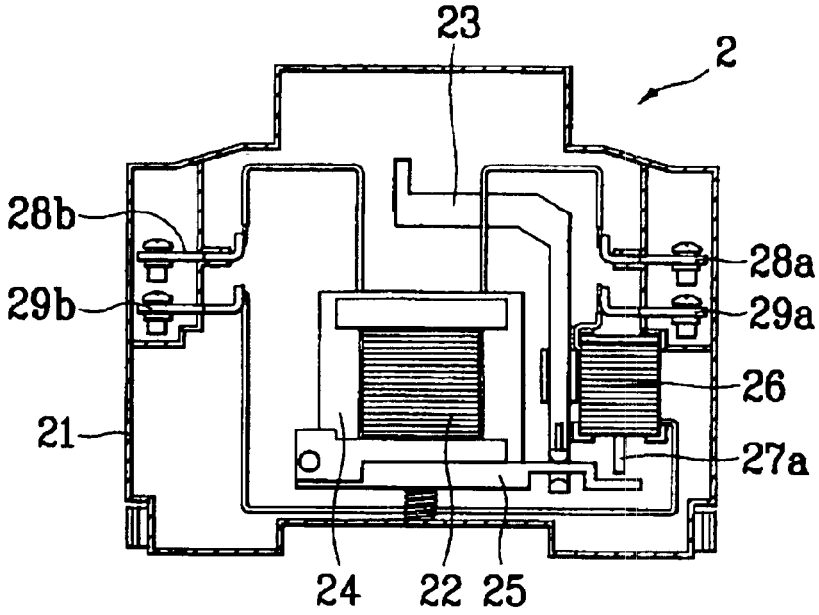
Figure 7:
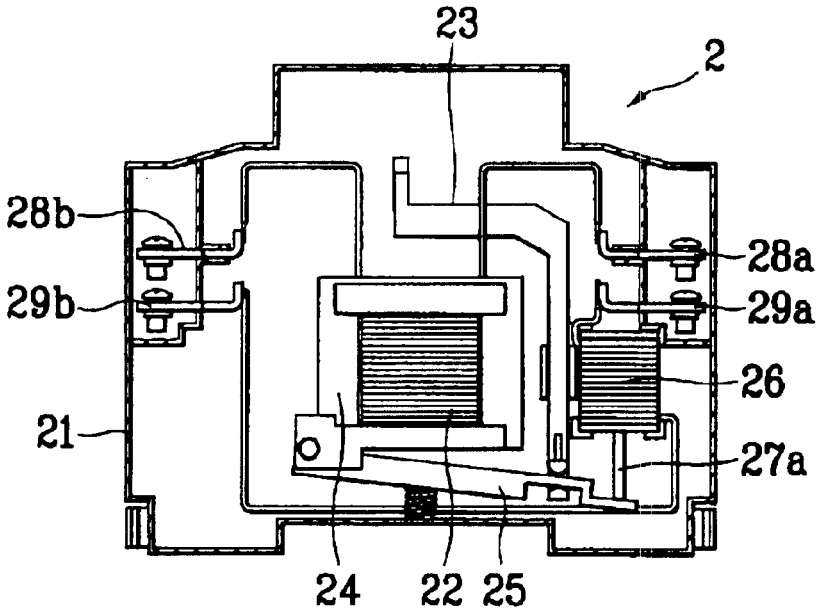

FIG. 4 is a perspective view showing an accessory device 2 according to one embodiment of the present invention, FIG. 5 is a perspective view showing an interior of the accessory device 2 according to one embodiment of the present invention, and FIGS. 6 and 7 are longitudinal sectional views of the accessory device 2 according to one embodiment of the present invention.

The accessory device 2 of the present invention includes a case 21 forming an outer appearance of the accessory device 2.

An under-voltage trip coil section is installed in the case 21. The under-voltage trip coil section includes an under-voltage trip coil 22 for generating magnetic flux depending on voltage applied thereto and a first fixed core 24 installed adjacent to the under-voltage trip coil 22 and magnetized by magnetic flux generated from the under-voltage trip coil 22, thereby generating attracting force.

A remotely switchable trip coil section is installed in the case 21. The remotely switchable trip coil includes a remotely switchable trip coil 26 for generating magnetic flux depending on remotely switchable electric source voltage applied thereto, a second fixed core 30 for generating attracting force when the second fixed core 30 is magnetized by magnetic flux generated from the remotely switchable trip coil 26, and a first movable core 27 having a rod portion 27*a* extending downward and movable in a downward direction when attracting force is applied thereto from the second fixed core 30.

Under-voltage trip power source terminals 28*a* and 28*b* are electrically connected to the under-voltage trip coil 22 so as to apply voltage to the under-voltage trip coil 22.

Remotely switchable trip power source terminals 29*a* and 29*b* are electrically connected to the remotely switchable trip coil 26 so as to apply remotely switchable electric source voltage to the remotely switchable trip coil 26.

A second movable core 25 is separated from the first fixed core 24 in a downward direction when under-voltage is applied thereto through the under-voltage trip power source terminals 28*a* and 28*b* and downwardly rotated pressed by the rod portion 27*a* of the first movable core when voltage is applied to the remotely switchable trip coil 26 through the remotely switchable trip power source terminals 29*a* and 29*b*.

A lever 23 is mechanically connected to the second movable core 25 so as to move together with the second movable core 25 for tripping the manual motor starter.

The case 21 is made of synthetic resin having an electric insulation property. As shown in FIGS. 4 and 5, the case 21 is fabricated with a slimmer width as possible in such a manner that a size and an occupying space of the case 21 cannot be significantly enlarged even if a body of the manual motor starter and the accessory device 2 are coupled to the case 21.

The under-voltage trip coil 22 is installed in a substantially inner center portion of the case 21 in longitudinal and transverse directions of the case 21. The under-voltage trip coil 22 is an electromagnet. That is, when voltage is applied to the under-voltage trip coil 22, the under-voltage trip coil 22 is magnetized so that the under-voltage trip coil 22 generates magnetic flux. If voltage is not applied to the under-voltage trip coil 22, the under-voltage trip coil 22 does not generate magnetic flux. The fixed core 24 is an iron core installed adjacent to the under-voltage trip coil 22. When magnetic flux is applied to the fixed core 24 from the under-voltage trip coil 22, the fixed core 24 is magnetized, thereby generating attracting force.

The under-voltage trip power source terminals 28*a* and 28*b* are connected to a circuit between a power source and a load in series. Accordingly, when voltage in the circuit is decreased below a normal level, under-voltage is applied to the under-voltage trip coil 22 from the under-voltage trip power source terminals 28*a* and 28*b* through conductors, such as conductor lines.

Figure 3:
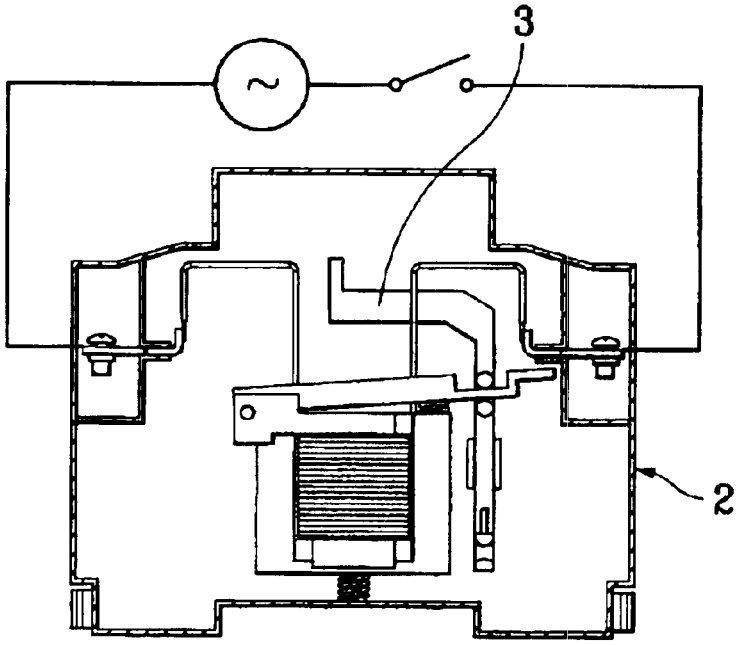
FIG. 3 PRIOR ART
FIG. 3 is a longitudinal sectional view of a conventional remotely switchable trip accessory device.

Remotely switchable trip power source terminals 29*a* and 29*b* can be electrically connected to an external power source and an external device, such as a switch installed in a remote place, in order to form a circuit in the similar manner as the conventional technique shown in FIG. 3. Accordingly, when the switch installed at the remote place is closed, external electric source voltage is applied to the remotely switchable trip coil 26 through the remotely switchable trip power source terminals 29*a* and 29*b*. The remotely switchable trip power source terminals 29*a* and 29*b* are electrically connected to the remotely switchable trip coil 26 in the case 21 by means of conductors, such as conductor lines. The remotely switchable trip power source terminals 29*a* and 29*b* are positioned below the under-voltage trip power source terminals 28*a* and 28*b*.

Figure 8:
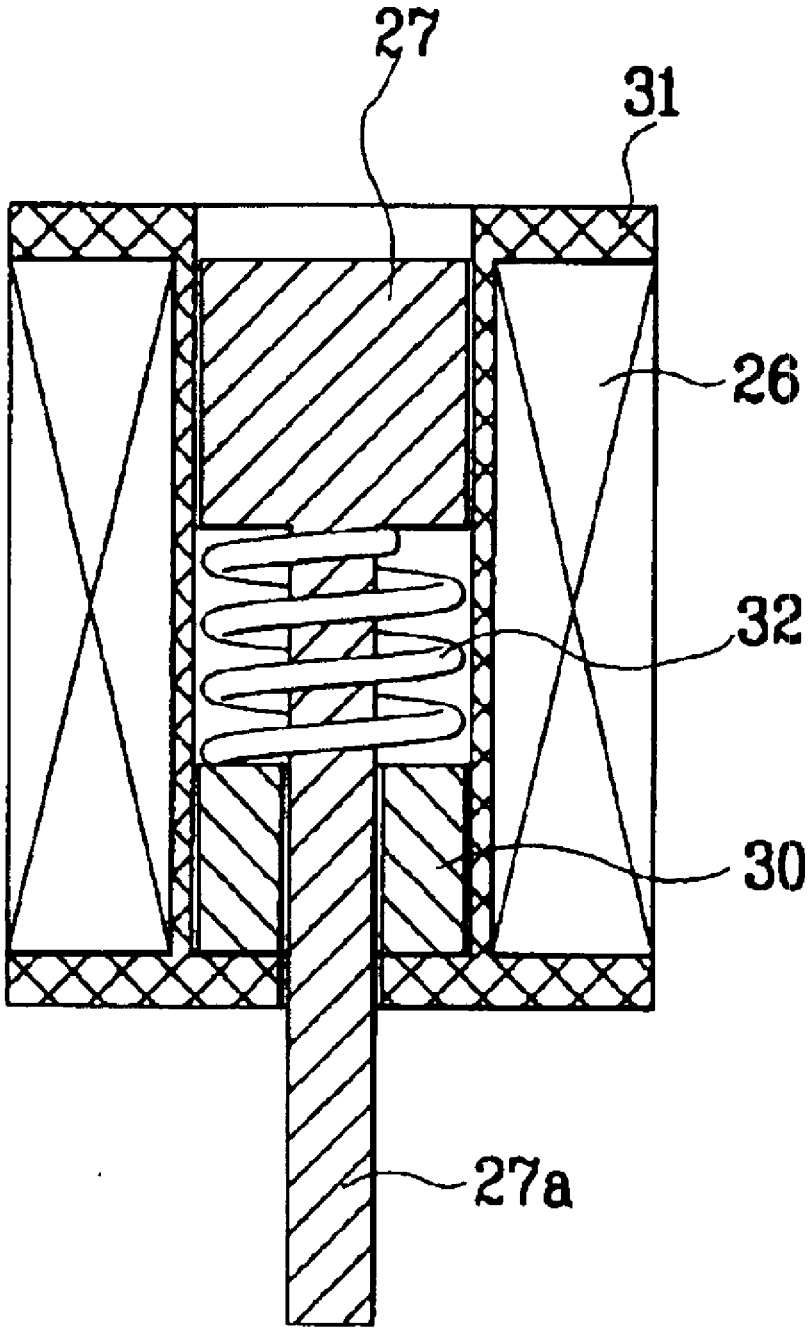
FIG. 8 is a sectional view showing a remotely switchable trip coil section according to one embodiment of the present invention.

The remotely switchable trip coil 26 of the remotely switchable trip coil section is positioned below the under-voltage trip power source terminals 28*a* and 28*b* and the remotely switchable trip power source terminals 29*a* and 29*b* in the case 21. The rod portion 27*a* downwardly extends from a lower portion of the remotely switchable trip coil 26. Hereinafter, a structure of the remotely switchable trip coil section will be described with reference to FIG. 8. As shown in FIG. 8, the remotely switchable trip coil 26 is wound around a bobbin 31. The second fixed core 30 has a ring shape and is installed in an inner portion of the remotely switchable trip coil 26, in detail, in an internal space defined by an internal peripheral surface of a body of the bobbin 31. The first movable core 27 is installed in the internal space of the bobbin 31 in opposition to the second fixed core 30. The first movable core 27 is movable from a first position closely adjacent to the second fixed core 30 to a second position upwardly apart from the second fixed core 30 depending on attractive force generated from the second fixing core 30. A spring 32 is installed between the second fixed core 30 and the first movable core 27 so as to elastically bias the first movable core 27 such that the first movable core 27 is separated from the second fixed core 30. The rod portion 27*a* downwardly extends from the lower portion of the first movable core 27 to an outer lower portion of the bobbin 31 by passing through the second fixed core 30.

The second movable core 25 is an iron core facing a lower portion of the first fixed core 24 and extending to the below the rod portion 27*a* of the remotely switchable trip core section. A hinge shaft is installed at one end of the rod portion 27*a* in such a manner that the second movable core 25 rotates clockwise or counterclockwise about the hinge shaft.

A lower end of the lever 23 is coupled to the second movable core 25 so that the lower end of the lever 23 can move together with the second movable core 25. An actuating part 23*a* formed at an upper end of the lever 23 extends by passing through the case 21. That is, the actuating part 23*a* formed on the upper end of the lever 23 is inserted into the body of the manual motor starter through a lever hole (referred to reference numeral 1 in FIG. 1) formed in the body of the manual motor starter so as to engage with a switching mechanism of the manual motor starter for driving the switching mechanism.

The accessory device of the present invention having the above construction can perform both under-voltage trip function and a remotely switchable trip function. Hereinafter, an operation of the accessory device of the present invention will be described.

Firstly, when normal voltage is applied to the under-voltage trip coil through the under-voltage trip power source terminals 28*a* and 28*b*, the second movable core 25 is closely adjacent to the first fixing core 24 due to attracting force of the first fixed core 24 as shown in FIG. 6. At this time, the lever 23 connected to the second movable core 25 is positioned at an upper portion in the case 21.

In this state, if voltage is insufficiently applied to the under-voltage trip coil through the under-voltage trip power source terminals 28*a* and 28*b*, attractive force of the first fixed core 24 becomes weak so that the second movable core 25 is separated from the first fixed core 24 due to elastic force of the spring 32 installed at a lower portion of the second movable core 25. In addition, the lever 23 connected to the second movable core 25 is downwardly moved in cooperated with the second movable core 25. At this time, the actuating part 23*a* formed at the upper end of the lever 23 operates the switching mechanism installed in the body 1 of the mutual motor starter, thereby tripping the mutual motor starter.

In addition, as shown in FIG. 6, in a state in which normal voltage is applied to the circuit formed between the power source and load so that the second movable core 25 is in contact with the first fixed core 24, if electric source voltage is applied to the remotely switchable trip coil 26 through the remotely switchable trip power source terminals 29*a* and 29*b*, the rod portion 27*a* of the first movable core 27 downwardly moves while pressing the second movable core 25 so that the second movable core 25 is downwardly rotated as shown in FIG. 7. As the second movable core 25 downwardly rotates, the lever 23 also downwardly moves so that the actuating part 23 is moved together with the lever 23, thereby tripping the manual motor starter.

That is, when voltage lower than rated voltage is applied to the accessory device of the present invention, the second movable core 25 is separated from the first fixed core 24 due to elastic force of the spring 32, so that the lever 23 is moved, thereby tripping the manual motor starter. In addition, if the user wants to trip the manual motor starter from a remote place by operating the switch, the second movable core 25 is downwardly rotated due to downward force of the first movable core 27, so the second movable core 25 is separated from the first fixed core 24. Thus, the lever 23 is moved by means of the second movable core 25, thereby tripping the manual motor starter.

Therefore, the remotely switchable trip function and the under-voltage trip function can be achieved by using one accessory device.

Although the accessory device is described as it is attached to the manual motor starter, the accessory device of the present invention can be applicable in various devices, such as a molded case circuit breaker or an electric leak breaker.

As described above, the accessory device according to the present invention can selectively perform two trip functions. That is, the remotely switchable trip function and the under-voltage trip function can be achieved by using one accessory device.

Accordingly, different from the conventional technique requiring two manual motor starters for forming a circuit capable of performing two trip functions, the accessory device of the present invention can make a circuit capable of performing two trip functions by using one accessory and one manual motor starter, so manufacturing cost of the manual motor starter can be saved, a circuit structure can be simplified, and an installation space for the manual motor starter can be reduced.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An accessory device for a manual motor starter, the accessory device comprising:

a case forming an outer appearance of the accessory device;

a under-voltage trip coil section installed in the case and including an under-voltage trip coil generating magnetic flux depending on voltage applied thereto and a first fixed core installed adjacent to the under-voltage trip coil and magnetize by magnetic flux generated from the under-voltage trip coil, thereby generating attracting force;

a remotely switchable trip coil section installed in the case and including a remotely switchable trip coil for generating magnetic flux depending on remotely switchable electric source voltage applied thereto, a second fixed core for generating attracting force when the second fixed core is magnetized by magnetic flux generated from the remotely switchable trip coil, and a first movable core having a rod portion extending downward and movable in a downward direction when attracting force is applied thereto from the second fixed core;

a under-voltage trip power source terminal electrically connected to the under-voltage trip coil so as to apply the voltage to the under-voltage trip coil;

a remotely switchable trip power source terminal electrically connected to the remotely switchable trip coil so as to apply remotely switchable electric source voltage to the remotely switchable trip coil;

a second movable core for separating from the first fixed core in a downward direction when under-voltage is applied thereto through the under-voltage trip power source terminal and for downwardly rotating pressed by the rod portion of the first movable core when the remotely switchable electric source voltage is applied to the remotely switchable trip coil through the remotely switchable trip power source terminal; and a lever mechanically connected to the second movable core so as to move together with the second movable core for tripping the manual motor starter.

2. The accessory device as claimed in claim 1, wherein the second movable core is positioned below the under-voltage trip coil section and the remotely switchable trip coil section in such a manner that the second movable core is rotated by means of one of under-voltage trip coil section and the remotely switchable trip coil section.

3. The accessory device as claimed in claim 1, wherein the remotely switchable trip coil section comprises:

a bobbin for winding the remotely switchable trip coil around an outer peripheral portion thereof;

the second fixed core having a ring shape and installed in an internal space defined by an internal peripheral surface of a body of the bobbin;

the first movable core installed in the internal space of the bobbin in opposition to the second fixing core and movable from a first position contacted with the second fixed core to a second position upwardly apart from the second fixed core depending on attracting force generated from the second fixed core;

a spring installed between the second fixed core and the first movable core for elastically biasing the first movable core such that the first movable core is separated from the second fixed core, and the rod portion downwardly extends from a lower portion of the first movable core to an outer lower portion of the bobbin by passing through the second fixed core and integrally movable together with the first moving core.

* * * * *

UNITED STATES PATENT AND TRADEMARK OFFICE

CERTIFICATE OF CORRECTION

PATENT NO. : 6,897,757 B2
DATED : May 24, 2005
INVENTOR(S) : H. S. Kim

It is certified that error appears in the above-identified patent and that said Letters Patent is hereby corrected as shown below:

Title page,
Item [73], Assignee, before "Industrial" insert -- LG --.

Column 7,
Line 20, "magnetize" should be -- magnetized --.

Signed and Sealed this

Thirty-first Day of January, 2006

JON W. DUDAS
*Director of the United States Patent and Trademark Office*